US007462205B2

(12) United States Patent
Murphy

(10) Patent No.: US 7,462,205 B2
(45) Date of Patent: Dec. 9, 2008

(54) TRIACYLGLYCEROL BASED CANDLE WAX

(75) Inventor: Timothy A. Murphy, Derby, KS (US)

(73) Assignee: Elevance Renewable Sciences, Inc., Bolingbrook, IL (US)

( * ) Notice: Subject to any disclaimer, the term of this patent is extended or adjusted under 35 U.S.C. 154(b) by 592 days.

(21) Appl. No.: 10/863,662

(22) Filed: Jun. 8, 2004

(65) Prior Publication Data

US 2004/0221504 A1 Nov. 11, 2004

Related U.S. Application Data

(63) Continuation of application No. 10/284,272, filed on Oct. 30, 2002, now Pat. No. 6,770,104, which is a continuation of application No. 09/854,138, filed on May 11, 2001, now Pat. No. 6,503,285.

(51) Int. Cl.
*C11C 5/00* (2006.01)

(52) U.S. Cl. ..... 44/275

(58) Field of Classification Search ..... 44/275
See application file for complete search history.

(56) References Cited

U.S. PATENT DOCUMENTS

| | | | |
|---|---|---|---|
| 1,935,946 | A | 11/1933 | Egan et al. |
| 1,954,659 | A | 4/1934 | Will |
| 3,630,697 | A | 12/1971 | Duling et al. |
| 3,645,705 | A | 2/1972 | Miller et al. |
| 3,744,956 | A | 7/1973 | Hess |
| 3,844,706 | A | 10/1974 | Tsaras |
| 4,118,203 | A | 10/1978 | Beardmore et al. |
| 4,134,718 | A | 1/1979 | Kayfetz et al. |
| 4,293,345 | A | 10/1981 | Zeilstra et al. |
| 4,314,915 | A | 2/1982 | Wiegers et al. |
| 4,390,590 | A | 6/1983 | Saunders et al. |
| 4,411,829 | A | 10/1983 | Schulte-Elte et al. |
| 4,434,306 | A | 2/1984 | Kobayashi et al. |
| 4,507,077 | A | 3/1985 | Sapper |
| 4,567,548 | A | 1/1986 | Schneeberger |
| 4,608,011 | A | 8/1986 | Comstock |
| 4,614,625 | A | 9/1986 | Wilson |
| 4,714,496 | A | 12/1987 | Luken, Jr. et al. |
| 4,759,709 | A | 7/1988 | Luken, Jr. et al. |
| 4,813,975 | A | 3/1989 | Poulina et al. |
| 4,842,648 | A | 6/1989 | Phadoemchit et al. |
| 4,855,098 | A | 8/1989 | Taylor |
| 5,171,329 | A | 12/1992 | Lin |
| 5,338,187 | A | 8/1994 | Elharar |
| 5,578,089 | A | 11/1996 | Elsamaloty |
| 5,753,015 | A | 5/1998 | Sinwald et al. |
| 5,843,194 | A | 12/1998 | Spaulding |
| 5,885,600 | A | 3/1999 | Blum et al. |
| 6,019,804 | A | 2/2000 | Requejo et al. |
| 6,022,402 | A | 2/2000 | Stephenson et al. |
| 6,063,144 | A | 5/2000 | Calzada et al. |
| 6,099,877 | A | 8/2000 | Schuppan |
| 6,106,597 | A | 8/2000 | Starks et al. |
| 6,132,742 | A | 10/2000 | Le Bras et al. |
| 6,156,369 | A | 12/2000 | Eger et al. |
| 6,214,918 | B1 | 4/2001 | Johnson et al. |
| 6,238,926 | B1 | 5/2001 | Liu et al. |
| 6,258,965 | B1 | 7/2001 | O'Lenick, Jr. |
| 6,276,925 | B1 | 8/2001 | Varga |
| 6,284,007 | B1 | 9/2001 | Tao |
| 6,497,735 | B2 | 12/2002 | Tao |
| 6,503,285 | B1 | 1/2003 | Murphy |
| 6,582,728 | B1 | 6/2003 | Platz et al. |
| 6,599,334 | B1 | 7/2003 | Anderson |
| 6,645,261 | B2 | 11/2003 | Murphy et al. |
| 2001/0013195 | A1 | 8/2001 | Tao |
| 2002/0005007 | A1 | 1/2002 | Roeske et al. |
| 2003/0008257 | A1 | 1/2003 | Tao |
| 2003/0017431 | A1 | 1/2003 | Murphy |
| 2003/0022121 | A1 | 1/2003 | Biggs |
| 2003/0061760 | A1 | 4/2003 | Tao et al. |
| 2005/0095545 | A1 | 5/2005 | Tischendorf |

FOREIGN PATENT DOCUMENTS

| | | | |
|---|---|---|---|
| EP | 0 685 554 | A1 | 12/1995 |
| JP | 4059897 | A | 2/1992 |
| JP | 6009987 | A | 1/1994 |
| WO | WO 96/14373 | | 5/1996 |

OTHER PUBLICATIONS

Behren et al., "Beeswax and other Non-Paraffin Waxes," Presented at NCA Technical Meeting, Jun. 19-20, 1991, 6 pages.

Bell et al., "Sperm Oil Replacements: Synthetic Wax Esters from Selectively Hydrogenated Soybean and Linseed Oils," *Journal of the American Oil Chemists' Society*, Jun. 1977, pp. 259-263, vol. 54.

Pages from Bitter Creek Candle Supply, Inc., Website (http://www.execpc.com.~bcsupply; now @ http://www.candlesupply.com), available at least by Jun. 29, 2000, 9 pages.

Pages from Ecowax, Nature's Gifts, Inc., Website (http://ngiwax.com/ecowax.htm), available at least by Jul. 5, 2000, 3 pages.

Pages from Heartland Candleworks Website, available @ www.candleworks.org, available at least by Feb. 11, 2000, 4 pages.

Frahm, "Harvest Lights: The only soy-based candle, a bright idea," available @ http://www.extension.uiuc.edu/~stratsoy/new/news/html/909166253,html, Oct. 23, 1998, 2 pages.

(Continued)

*Primary Examiner*—Cephia D Toomer
(74) *Attorney, Agent, or Firm*—Brinks Hofer Gilson & Lione

(57) ABSTRACT

A triacylglycerol-based wax includes a triacylglycerol component and a polyol fatty acid partial ester component. The triacylglycerol-based wax may have a melting point of about 54° C. to 63° C., may have an Iodine Value of about 20 to 40, and may have a fatty acid profile including about 50 to 70 wt. % saturated fatty acids. The wax may be suitable for use as a candle.

21 Claims, No Drawings

OTHER PUBLICATIONS

*In Business*, "America's Shining Example of Sustainable Business," available @ http://www.candleworks.org, Mar./Apr. 1998, 3 pages.
Noller, Chemistry of Organic Compounds, W.B. Saunders Company, 1957, pp. 181 and 192.
Orso, "New Use for Soybeans Has Bright Future," available @ http://www.unitedsoybean.com/news/nr981014.htm, Oct. 14, 1998, 2 pages.
Purdue Agriculture News, Purdue May Agriculture & Natural Resources Package, available @ http://purduenews.uns.purdue.edu/UNS/paks/agpak.digest.9605.html, May 1996, 3 pages.
Purdue News, "Purdue students put the 'happy' back into birthday candles," available @ http://www.purdue.edu/UNS/html4ever/9611.Schweitzer.candles.html, Nov. 1996, 3 pages.
Purdue News, "Purdue students put the 'happy' back into birthday candles," available @ http:/www.purdue.edu/UNS/html4ever/9604.schweitzer.html, May 1996, 2 pages.
Purdue University School of Agriculture, 1998 Farm Progress Show, available @ http://www.admin.ces.purdue.edu/anr/98fps/fpspix/930.html, 1998, 4 pages.
Tao, "Development of Vegetable Lipid-Based Candles," available at http://abe.www.ecn.purdue.edu/ABE/Research/research94/REPORT.94.Book_68.html, 1994, 2 pages.

TRIACYLGLYCEROL BASED CANDLE WAX

CROSS-REFERENCE TO RELATED PATENT APPLICATIONS

This applications is a continuation of U.S. application Ser. No. 10/284,272, filed Oct. 30, 2002, now U.S. Pat. No. 6,770,104, which is a Continuation of U.S. application Ser. No. 09/854,138, filed May 11, 2001, now U.S. Pat. No. 6,503,285, the disclosures of each of which are incorporated herein by reference in their entirety.

BACKGROUND

Candles have been known and used for illumination since early civilization. A typical candle is formed of a solid or semi-solid body of combustible waxy material and contains an combustible fibrous wick embedded within the waxy material. When the wick of a candle is lit, the generated heat melts the solid wax, and the resulting liquid flows up the wick by capillary action and is combusted. At present, although many advanced illuminating devices are available, candles are still popularly used for decoration or on a special situation as a holiday.

For a long time, beeswax was has been in common usage as a natural wax for candles. Over one hundred years ago, paraffin came into existence, in parallel with the development of the petroleum refining industry. Paraffin is produced from the residue leftover from refining gasoline and motor oils. Paraffin was introduced as a bountiful and low cost alternative to beeswax, which had become more and more costly and in more and more scarce supply.

Today, paraffin is the primary industrial wax used to produce candles. Conventional candles produced from a paraffin wax material typically emit a smoke and can produce a bad smell when burning. In addition, a small amount of particles ("particulates") can be produced when the candle burns. These particles may affect the health of a human when breathed in.

Accordingly, it would be advantageous to have other materials which can be used to form clean burning base wax for forming candles. If possible, such materials would preferably be biodegradable and be derived from renewable raw materials. The candle base waxes should preferably have physical characteristics, e.g., in terms of melting point, hardness and/or malleability, that permit the material to be readily formed into candles having a pleasing appearance and/or feel to the touch, as well as having desirable olfactory properties.

In the past, attempts to formulate candle waxes from vegetable oil-based materials have often suffered from a variety of problems. For example, relative to paraffin-based candles, vegetable oil-based candles have been reported to exhibit one or more disadvantages such as cracking, air pocket formation, product shrinkage and a natural product odor associated with soybean materials. Various soybean-based waxes have also been reported to suffer performance problems relating to optimum flame size, effective wax and wick performance matching for an even burn, maximum burning time, product color integration and/or product shelf life. In order to achieve the aesthetic and functional product surface and quality sought by consumers of candles, it would be advantageous to develop new vegetable oil-based waxes that overcome as many of these deficiencies as possible.

SUMMARY

The present invention relates to candles having low paraffin content and methods of producing such candles. The candles are typically formed from a tricylglycerol-based wax, such as vegetable oil-based wax, a biodegradable material produced from renewable resources. Since the candles are formed from a material with a low paraffin content and preferably are substantially devoid of paraffin, the candles are generally clean burning, emitting very little soot. The combination of low soot emission, biodegradability and production from renewable raw material makes the present candle a particularly environmentally friendly product.

The present wax may be useful in forming votive, pillar and votive candles. The wax is desirably formulated to inhibit surface adhesion to facilitate release of a candle from its mold in the production of pillar and/or votive candles. Good mold release is an important economic consideration in the manufacture of candles, allowing rapid production. In addition, it is desirable that the wax is capable of being blended with natural color additives to provide an even solid color distribution.

The triacylglycerol-based wax which may be used to form the present candles is typically solid, firm but not brittle, generally somewhat malleable, with no free oil visible. The wax includes a triacylglycerol component and a polyol fatty acid partial ester component and generally has a melting point of about 130 to 145° F. (circa 54 to 63° C.). The wax is commonly predominantly made up of a mixture of the triacylglycerol component and the polyol fatty acid partial ester component, e.g., the wax commonly includes at least about 70 wt. % of the triacylglycerol component and about 3 to 30 wt. % of the polyol partial ester component. Desirably, the triacylglycerol-based wax has an Iodine Value of about 20 to 40. The triacylglycerol component generally has a fatty acid composition which includes about 50 to 70 wt. % saturated fatty acids and about 30 to 45 wt. % 18:1 fatty acids.

In general, oils extracted from any given plant or animal source comprise a mixture of triacylglycerols characteristic of the specific source. The mixture of fatty acids isolated from complete hydrolysis of the triacylglycerols and/or other fatty acid esters in a specific sample are referred herein to as the "fatty acid composition" of that sample. By the term "fatty acid composition" reference is made to the identifiable fatty acid residues in the various esters. The distribution of fatty acids in a particular oil or mixture of esters may be readily determined by methods known to those skilled in the art, e.g., via gas chromatography or conversion to a mixture of fatty acid methyl esters followed by analysis by gas chromatography.

The polyol fatty acid partial ester component can be derived from partial saponification of a vegetable-oil based material and consequently may include a mixture of two or more fatty acids. For example, the polyol fatty acid partial ester component may suitably include polyol partial esters palmitic acid and/or stearic acid, e.g., where at least about 90 wt. % of the fatty acid which is esterified with the polyol is palmitic acid, stearic acid or a mixture thereof. Examples of suitable polyol partial esters include fatty acid partial esters of glycerol and/or sorbitan, e.g., glycerol and/or sorbitan monoesters of mixtures of fatty acids having 14 to 24 carbon atoms. More desirably, at least about 90 wt. % of the fatty acyl groups in the polyol partial esters have 16 or 18 carbon atoms. As employed herein, the term "fatty acyl group" refers to an acyl group ("—C(o)R") which includes an aliphatic chain (linear or branched).

The triacylglycerol component may suitably be chosen to have a melting point of about 54° C. to 63° C. (circa 130° F.

to 145° F.). One embodiment of such a triacylglycerol stock can be formed by blending fully hydrogenated and partially hydrogenated vegetable oils to produce a blend with an Iodine Value of about 25-45 and the desired melting point. For example, a suitable triacylglycerol stock can be formed by blending appropriate amounts of fully hydrogenated soybean and/or palm oils with a partially hydrogenated soybean oil having an Iodine Value of about 60 to 75. As used herein, a "fully hydrogenated" vegetable oil refers to a vegetable oil which has been hydrogenated to an Iodine Value of no more than about 5. The term "hydrogenated" is used herein to refer to fatty acid ester-based stocks that are either partially and fully hydrogenated. Instead of employing a highly hydrogenated vegetable oil, a highly unsaturated triacylglycerol material derived from precipitating a hard fat fraction from a vegetable oil may be employed. Hard fat fractions-obtained in this manner are predominantly composed of saturated triacylglycerols.

It is generally advantageous to minimize the amount of free fatty acid(s) in the triacylglycerol-based wax. Since carboxylic acids are commonly somewhat corrosive, the presence of fatty acid(s) in a triacylglycerol-based wax can increase its irritancy to skin. The present triacylglycerol-based wax generally has free fatty acid content ("FFA") of no more than about 1.0 wt. % and, preferably no more than about 0.5 wt. %.

It has been reported that a candle with a string-less wick can be formed by suspending fine granular or powdered material, such as silica gel flour or wheat fiber in a vegetable oil such as soybean oil, cottonseed oil and/or palm oil. The inclusion of particulate material in a candle wax can result in a two phase material and alter the visual appearance of a candle. Accordingly, the present triacylglycerol-based wax is preferably substantially free (e.g., includes no more than about 0.5 wt. %) of particulate material. As used herein, the term "particulate material" refers to any material that will not dissolve in the triacylglycerol component of the wax, when the wax is in a molten state.

The triacylglycxerol-based wax may also include minor amounts of other additives to modify the properties of the waxy material. Examples of types of additives which may commonly be incorporated into the present candles include colorants, fragrances (e.g., fragrance oils), insect repellants and migration inhibitors.

If the present wax is used to produce a candle, the same standard wicks that are employed with other waxes (e.g., paraffin and/or beeswax) can be utilized. In order to fully benefit from the environmentally-safe aspect of the present wax, it is desirable to use a wick which does not have a metal core, such as a lead or zinc core. One example of a suitable wick material is a braided cotton wick.

The present candles may be formed by a method which includes heating the triacylglycerol-based wax to a molten state and introduction of the molten triacylglycerol-based wax into a mold which includes a wick disposed therein. The molten triacylglycerol-based wax is cooled in the mold to solidify the wax and the solidified wax is removed from the mold. This is facilitated by the use of a wax, such as the present triacylglycerol-based wax, which does not adhere to the sides of the mold.

DETAILED DESCRIPTION

The physical properties of a triacylglycerol are primarily determined by (i) the chain length of the fatty acyl chains, (ii) the amount and type (cis or trans) of unsaturation present in the fatty acyl chains, and (iii) the distribution of the different fatty acyl chains among the triacylglycerols that make up the fat or oil. Those fats with a high proportion of saturated fatty acids are typically solids at room temperature while triacylglycerols in which unsaturated fatty acyl chains predominate tend to be liquid. Thus, hydrogenation of a triacylglycerol stock ("TAGS") tends to reduce the degree of unsaturation and increase the solid fat content and can be used to convert a liquid oil into a semisolid or solid fat. Hydrogenation, if incomplete (i.e., partial hydrogenation), also tends to result in the isomerization of some of the double bonds in the fatty acyl chains from a cis to a trans configuration. By altering the distribution of fatty acyl chains in the triacylglycerol moieties of a fat or oil, e.g., by blending together materials with different fatty acid profiles, changes in the melting, crystallization and fluidity characteristics of a triacylglycerol stock can be achieved.

Herein, when reference is made to the term "triacylglycerol-based material" the intent is to refer to a material made up predominantly of triacylglycerols, i.e, including at least about 50 wt. %, more typically including at least about 70 wt. % and, more desirably including about 85 wt. % or more triacylglycerol(s).

As employed herein, the terms "triacylglycerol stock" and "triacylglycerol component" are used interchangeably to refer to materials that are made up entirely of one or more triacylglycerol compounds. Commonly, the triacylglycerol stock or triacylglycerol component is a complex mixture triacylglycerol compounds, which very often are predominantly derivatives of C16 and/or C18 fatty acids. The triacylglycerol stock, whether altered or not, is commonly derived from various animal and/or plant sources, such as oil seed sources. The terms at least include within their scope: (a) such materials which have not been altered after isolation; (b) materials which have been refined, bleached and/or deodorized after isolation; (c) materials obtained by a process which includes fractionation of a triacylglycerol oil; and, also, (d) oils obtained from plant or animal sources and altered in some manner, for example through interesterification and/or partial hydrogenation. Herein, the terms "triacylglycerols" and "triglycerides" are intended to be interchangeable. It will be understood that a triacylglycerol stock may include a mixture of triacylglycerols, and a mixture of triacylglycerol isomers. By the term "triacylglycerol isomers," reference is meant to triacylglycerols which, although including the same esterified carboxylic acid residues, may vary with respect to the location of the residues in the triacylglycerol. For example, a triacylglycerol oil such as a vegetable oil stock can include both symmetrical and unsymmetrical isomers of a triacylglycerol molecule which includes two different fatty acyl chains (e.g., includes both stearate and oleate groups).

Any given triacylglycerol molecule includes glycerol esterified with three carboxylic acid molecules. Thus, each triacylglycerol includes three fatty acid residues. In general, oils extracted from any given plant or animal source comprise a mixture of triacylglycerols, characteristic of the specific source. The mixture of fatty acids isolated from complete hydrolysis of the triacylglycerols in a specific source is referred to herein as a "fatty acid profile." By the term "fatty acid profile" reference is made to the dentifiable fatty acid residues in the various triacylglycerols. The distribution of specific identifiable fatty acids is characterized herein by the amounts of the individual fatty acids as a weight percent of the total mixture of fatty acids obtained from hydrolysis of the particular mixture of esters. The distribution of fatty acids in a particular oil, fat or ester stock may be readily determined by methods known to those skilled in the art, such as by gas chromatography.

Palmitic acid ("16:0") and stearic acid ("18:0") are saturated fatty acids and triacylglycerol acyl chains formed by the esterification of either of these acids do not contain any carbon-carbon double bonds. The nomenclature in the above abbreviations refers to the number of total carbon atoms in a fatty acid (or fatty acyl group in an ester) followed by the number of carbon-carbon double bonds in the chain. Many fatty acids such as oleic acid, linoleic acid and linolenic acid are unsaturated, i.e., contain one or more carbon-carbon double bonds. Oleic acid is an 18 carbon fatty acid with a single double bond (i.e., an 18:1 fatty acid), linoleic acid is an 18 carbon fatty acid with two double bonds or points of unsaturation (i.e., an 18:2 fatty acid), and linolenic is an 18 carbon fatty acid with three double bonds (i.e., an 18:3 fatty acid).

The fatty acid profile of the triacylglycerol stock which makes up a significant portion of the present triacylglycerol-based wax generally consists predominantly of fatty acids having 16 and 18 carbon atoms. The amount of shorter chain fatty acids, i.e., fatty acids having 14 carbon atoms or less in the fatty acid profile of the triacylglycerols is generally very low, e.g., no more than about 5.0 wt. % and more typically no more than about 1.0 or 2.0 wt. %. The triacylglycerol stock generally includes a moderate amount of saturated 16 carbon fatty acid, e.g., at least about 8 wt. % and typically no more than about 25 wt. %. One type of suitable suitable triacylglycerol stocks include about 15 wt. % to 20 wt. % saturated 16 carbon fatty acid.

The fatty acid profile of the triacylglycerols commonly includes a significant amount of C18 fatty acids. In order to achieve a desirable melting/hardness profile, the fatty acids typically include a mixture of saturated (e.g., stearic acid; "18:0" acid) and monounsaturated fatty acids (e.g., 18:1 acids). The unsaturated fatty acids are predominantly monounsaturated 18:1 fatty acids, such as oleic acid. Desirably, the triacylglycerols have a fatty acid profile which includes about 50 to 70 wt. % and, more desirably, about 50 to 65 wt. % saturated fatty acids and about 30 to 45 wt. % 18:1 fatty acids. The saturated fatty acids are generally a mixture of 16:0 fatty acid (e.g., about 8 to 25 wt. % based on the total fatty acid profile of the triacyglycerol component) and 18:0 fatty acid (e.g., about 30 to 45 wt. % based on the total fatty acid profile of the triacyglycerol component).

The triacylglycerols' fatty acid profile is typically selected to provide a triacylglycerol-based material with a melting point of about 54 to 63° C. In some instances it may be desirable to select a triacylglycerol stock with a melting point of about 57 to 60° C. (circa 135 to 140° F.) since waxes based on such stocks can have advantageous properties for producing votive, pillar and/or taper candles. The selection of a triacylglycerol stock with a particular melting point can be done by altering several different parameters. As indicated herein, the primary factors which influence the solid fat and melting point characteristics of a triacylglycerol are the chain length of the fatty acyl chains, the amount and type of unsaturation present in the fatty acyl chains, and the distribution of the different fatty acyl chains within individual triacylglycerol molecules. The present triacylglycerol-based materials are commonly formed from triacylglycerols with fatty acid profiles dominated by C18 fatty acids (fatty acids with 18 carbon atoms). Triacylglycerols with extremely large amounts of saturated 18 carbon fatty acid (also referred to as 18:0 fatty acid or stearic acid) can have melting points which may be too high for the producing the present candles since such materials may be prone to brittleness and cracking. The melting point of such triacylglcerols can be lowered by including more shorter chain fatty acids and/or unsaturated fatty acids. Since the present triacylglycerol-based materials typically have fatty acid profiles in which C16 and C18 fatty acids predominate, the desired the melting point and/or solid fat index can be achieved by altering the amount of unsaturated C18 fatty acids present (predominantly 18:1 fatty acid(s)). The triacylglycerol stocks employed in the present triacylglycerol-based waxes are desirably selected to have a melting point of about 54 to 63° C. (circa 130-145° F.).

The method(s) described herein can be used to provide candles from triacylglycerol-based materials having a melting point and/or solid fat content which imparts desirable molding and/or burning characteristics. The solid fat content as determined at one or more temperatures can be used as a measure of the fluidity properties of a triacylglycerol stock. The melting characteristics of the triacylglycerol-based material may be controlled based on its solid fat index. The solid fat index is a measurement of the solid content of a triacylglycerol material as a function of temperature, generally determined at number of temperatures over a range from 10° C. (50° F.) to 40° C. (104° F.). Solid fat content ("SFC") can be determined by Differential Scanning Calorimetry ("DSC") using the methods well known to those skilled in the art. Fats with lower solid fat contents have a lower viscosity, i.e., are more fluid, than their counterparts with high solid fat contents.

The melting characteristics of the triacylglycerol-based material may be controlled based on its solid fat index to provide a material with desirable properties for forming a candle. Although the solid fat index is generally determined by measurement of the solid content of a triacylglycerol material as a function over a range of 5 to 6 temperatures, for simplicity triacylglycerol-based materials can be characterized in terms of their solid fat contents at 10° C. ("SFI-10") and/or 40° C. ("SFI-40").

One measure for characterizing the average number of double bonds present in a triacylglycerol stock which includes triacylglycerol molecules with unsaturated fatty acid residues is its Iodine Value. The Iodine Value of a triacylglycerol or mixture of triacylglycerols is determined by the Wijs method (A.O.C.S. Cd 1-25). For example, unprocessed soybean oil typically has an Iodine Value of about 125 to 135 and a pour point of about 0° C. to −10° C. Hydrogenation of soybean oil to reduce its Iodine Value to 90 or less increases the melting point of the material as evidenced by the increased in its pour point to 10 to 20° C. Further hydrogenation can produce a material which is a solid at room temperature and may have a melting point of 70° C. or even higher. Typically, the present candles are formed from triacylglycerol-based waxes which include a triacylglycerol component having an Iodine Value of about 25 to 45, and more desirably about 30 to 40.

Feedstocks used to produce the triacylglycerol component in the present candle stock material have generally been neutralized and bleached. The triacylglycerol stock may have been processed in other ways prior to use, e.g., via fractionation, hydrogenation, refining, and/or deodorizing. Preferably, the feedstock is a refined, bleached triacylglycerol stock. The processed feedstock material may be blended with one or more other triacylglycerol feedstocks to produce a material having a desired distribution of fatty acids, in terms of carbon chain length and degree of unsaturation. Typically, the triacylglycerol feedstock material is hydrogenated to reduce the overall degree of unsaturation in the material and provide a triacylglycerol material having physical properties which are desirable for a candle-making base material.

Suitable hydrogenated vegetable oils for use in the present triacylglycerol-based material includes hydrogenated soybean oil, hydrogenated cottonseed oil, hydrogenated sunflower oil, hydrogenated canola oil, hydrogenated corn oil, hydrogenated olive oil, hydrogenated peanut oil, hydrogenated safflower oil or mixtures thereof. The vegetable oil may be hydrogenated to obtain a desired set of physical characteristics, e.g., in terms of melting point, solid fat content and/or Iodine value. The hydrogenation is typically carried out at elevated temperature, such as 400° F. to 450° F. (about 205° C. to 230° C.), and relatively low hydrogen pressure (e.g., no more than about 25 psi) in the presence of a hydrogenation catalyst. One example of a suitable hydrogenation catalyst, is a nickel catalyst, such as a powdered nickel catalyst provided as a 20-30 wt. % in a solid vegetable oil.

The following discussion of the preparation of a vegetable oil derived candle stock material is described as a way of exemplifying a method for producing the present triacylglycerol-based material. A partially hydrogenated refined, bleached vegetable oil, such as a refined, bleached ("RB") soybean oil which has been hydrogenated to an Iodine Value of about 60-75, may be blended with a second oil seed derived material having a higher melting point, e.g., a fully hydrogenated soybean or palm oil. The resulting blend may be too brittle for use in making a pillar or votive candle. The vegetable oil blend could, however, be blended with a polyol fatty acid partial ester component (e.g., a mixture of glycerol monopalmitate and glycerol monostearate) until the melting point and/or solid fat index of the resulting material had been modified to fall within a desired range. The final candle wax formulation would then include a mixture of a triacylglycerol component and a polyol fatty acid partial ester component.

Polyols which can be used to form the fatty acid partial esters used in the present wax compositions include at least two and, preferably, at least three hydroxy groups per molecule (also referred to as "polyhydric alcohols"). Typically, the polyols have no more than 6 hydroxy groups per molecule and include up to 10 carbon atoms and more commonly no more than 6 carbon atoms. Examples of suitable aliphatic polyols include glycerol, alkylene glycols (e.g., ethylene glycol, diethylene glycol, triethylene glycol and neopentylglycol), pentaerythritol, trimethylolethane, trimethylolpropane, sorbitan and sorbitol. Suitable alicyclic polyols include cyclohexanediols and inositol as well as natural cyclic polyols such as glucose, galactose and sorbose.

The polyol partial esters employed in the present wax compositions have one or more unesterified hydroxyl groups with the remaining hydroxy groups esterified by a fatty acyl group. The fatty acyl groups ("—C(O)R") in the partial esters include an aliphatic chain (linear or branched) and typically have from 14 to 30 carbon atoms. Typically, the partial esters have a fatty acid composition which includes at least about 90 wt. % fatty acyl groups having from about 14 to 24 carbon atoms. More commonly, at least about 90 wt. % of the fatty acyl groups with aliphatic chains having from about 16 or 18 carbon atoms. The fatty acid partial esters typically have an Iodine Value of no more than about 130. Very often, the partial esters are formed from a mixture of fatty acids that has been hydrogenated to have an Iodine Value of no more than about 50, desirably no more than about 20 and, more desirably, no more than about 5.

Fatty acid partial esters of polyols which include no more than about 6 carbon atoms and have three to six hydroxy groups per molecule, such as glycerol, pentaerythritol, trimethylolethane, trimethylolpropane, sorbitol, sorbitan, inositol, glucose, galactose, and/or sorbose, are suitable for use in the present invention. Glycerol and/or sorbitan partial esters are particularly suitable examples of polyol partial esters which can be used to form the present wax compositions.

Fatty acid monoesters of polyols are particularly suitable for use in the present wax compositions. Suitable examples include glycerol monoesters, e.g., glycerol monostearate, glycerol monopalmitate, and/or glycerol monooleate, and/or sorbitan monoesters; e.g., sorbitan monostearate, sorbitan monopalmitate, and/or sorbitan monooleate. Monoesters which are produced by partial esterification of a polyol with a mixture of fatty acids derived from hydrolysis of a triacylglycerol stock are also suitable for use in the present wax compositions. Examples include monoglycerol esters of a mixture of fatty acids derived from hydrolysis of a partially or fully hydrogenated vegetable oil, e.g., fatty acids derived from hydrolysis of partially or fully hydrogenated soybean oil.

Other examples of suitable polyol partial esters include di- and/or triesters of higher polyols, e.g, include di- and/or triesters of a polyol having 5 hydroxy groups, such as sorbitan. For example, the present wax compositions may include one or more sorbitan triesters of fatty acids having 16 to 18 carbon atoms, e.g., sorbitan tristearate, sorbitan tripalmitate, sorbitan trioleate, and mixtures including one or more of these triesters.

Candles can be produced from the triacylglycerol-based material using a number of different methods. In one common process, the vegetable oil-based wax is heated to a molten state. If other additives such as colorants and/or fragrance oils are to be included in the candle formulation, these may be added to the molten wax or mixed with vegetable oil-based wax prior to heating. The molten wax is then solidified around a wick. For example, the molten wax can be poured into a mold which includes a wick disposed therein. The molten wax is then cooled to the solidify the wax in the shape of the mold. Depending on the type of candle being produced, the candle may be unmolded or used as a candle while still in the mold. Examples of candles which may be produced by this method include pillar candles and votive candles. Where the candle is designed to be used in unmolded form, it may also be coated with an outer layer of higher melting point material.

Alternatively, the triacylglycerol-based material can be formed into a desired shape, e.g., by pouring molten vegetable oil-based wax into a mold and removing the shaped material from the mold after it has solidified. A wick may then be inserted into the shaped waxy material using techniques known to those skilled in the art, e.g., using a wicking machine such as a Kurschner wicking machine.

The candle wax may be fashioned into a variety of forms, commonly ranging in size from powdered or ground wax particles approximately one-tenth of a millimeter in length or diameter to chips, flakes or other pieces of wax approximately two centimeters in length or diameter. Where designed for use in compression molding of candles, the waxy particles are generally spherical, prilled granules having an average mean diameter no greater than one (1) millimeter.

Prilled waxy particles may be formed conventionally, by first melting a triacylglycerol-based material, in a vat or similar vessel and then spraying the molten waxy material through a nozzle into a cooling chamber. The finely dispersed liquid solidifies as it falls through the relatively cooler air in the chamber and forms the prilled granules that, to the naked eye, appear to be spheroids about the size of grains of sand. Once formed, the prilled triacylglycerol-based material can be deposited in a container and, optionally, combined with the coloring agent and/or scenting agent.

The candle wax may be packaged as part of a candle-making kit, e.g., in the form of beads or flakes of wax, which includes also typically would include instructions with the candle wax. The candle-making kit typically would also include material which can be used to form a wick.

A wide variety of coloring and scenting agents, well known in the art of candle making, are available for use with waxy materials. Typically, one or more dyes or pigments is employed provide the desired hue to the color agent, and one or more perfumes, fragrances, essences or other aromatic oils is used provide the desired odor to the scenting agent. The coloring and scenting agents generally also include liquid carriers which vary depending upon the type of color- or scent-imparting ingredient employed. The use of liquid organic carriers with coloring and scenting agents is preferred because such carriers are compatible with petroleum-based waxes and related organic materials. As a result, such coloring and scenting agents tend to be readily absorbed into waxy materials. It is especially advantageous if a coloring and/or scenting agent is introduced into the waxy material when it is in the form of prilled granules.

The colorant is an optional ingredient and is commonly made up of one or more pigments and dyes. Colorants are typically added in a quantity of about 0.001-2 wt. % of the waxy base composition. If a pigment is employed, it is typically an organic toner in the form of a fine powder suspended in a liquid medium, such as a mineral oil. It may be advantageous to use a pigment that is in the form of fine particles suspended in a vegetable oil, e.g., an natural oil derived from an oilseed source such as soybean or corn oil. The pigment is typically a finely ground, organic toner so that the wick of a candle formed eventually from pigment-covered wax particles does not clog as the wax is burned. Pigments, even in finely ground toner forms, are generally in colloidal suspension in a carrier.

If a dye constituent is utilized, it may be dissolved in an organic solvent. A variety of pigments and dyes suitable for candle making are listed in U.S. Pat. No. 4,614,625, the disclosure of which is herein incorporated by reference. The preferred carriers for use with organic dyes are organic solvents, such as relatively low molecular weight, aromatic hydrocarbon solvents; e.g. toluene and xylene. The dyes ordinarily form true solutions with their carriers. Since dyes tend to ionize in solution, they are more readily absorbed into the prilled wax granules, whereas pigment-based coloring agents tend to remain closer to the surface of the wax.

Candles often are designed to appeal to the olfactory as well as the visual sense. This type of candle usually incorporates a fragrance oil in the waxy body material. As the waxy material is melted in a lighted candle, there is a release of the fragrance oil from the liquefied wax pool. The scenting agent may be an air freshener, an insect repellent or more serve more than one of such functions.

The air freshener ingredient commonly is a liquid fragrance comprising one or more volatile organic compounds which are available from perfumery suppliers such IFF, Firmenich Inc., Takasago Inc., Belmay, Noville Inc., Quest Co., and Givaudan-Roure Corp. Most conventional fragrance materials are volatile essential oils. The fragrance can be a synthetically formed material, or a naturally derived oil such as oil of Bergamot, Bitter Orange, Lemon, Mandarin, Caraway, Cedar Leaf, Clove Leaf, Cedar Wood, Geranium, Lavender, Orange, Origanum, Petitgrain, White Cedar, Patchouli, Lavandin, Neroli, Rose and the like.

A wide variety of chemicals are known for perfumery such as aldehydes, ketones, esters, alcohols, terpenes, and the like. A fragrance can be relatively simple in composition, or can be a complex mixture of natural and synthetic chemical components. A typical scented oil can comprise woody/earthy bases containing exotic constituents such as sandalwood oil, civet, patchouli oil, and the like. A scented oil can have a light floral fragrance, such as rose extract or violet extract. Scented oil also can be formulated to provide desirable fruity odors, such as lime, lemon or orange.

Synthetic types of fragrance compositions either alone or in combination with natural oils such as described in U.S. Pat. Nos. 4,314,915; 4,411,829; and 4,434,306; incorporated herein by reference. Other artificial liquid fragrances include geraniol, geranyl acetate, eugenol, isoeugenol, linalool, linalyl acetate, phenethyl alcohol, methyl ethyl ketone, methylionone, isobomyl acetate, and the like. The scenting agent can also be a liquid formulation containing an insect repellent such as citronellal, or a therapeutic agent such as eucalyptus or menthol. Once the coloring and scenting agents have been formulated, the desired quantities are combined with waxy material which will be used to form the body of the candle. For example, the coloring and/or scenting agents can be added to the waxy materials in the form of prilled wax granules. When both coloring and scenting agents are employed, it is generally preferable to combine the agents together and then add the resulting mixture to the wax. It is also possible, however, to add the agents separately to the waxy material. Having added the agent or agents to the wax, the granules are coated by agitating the wax particles and the coloring and/or scenting agents together. The agitating step commonly consists of tumbling and/or rubbing the particles and agent(s) together. Preferably, the agent or agents are distributed substantially uniformly among the particles of wax, although it is entirely possible, if desired, to have a more random pattern of distribution. The coating step may be accomplished by hand, or with the aid of mechanical tumblers and agitators when relatively large quantities of prilled wax are being colored and/or scented.

Certain additives may be included in the present wax compositions to decrease the tendency of colorants, fragrance components and/or other components of the wax to migrate to an outer surface of a candle. Such additives are referred to herein as "migration inhibitors." The wax may include 0.1 to 5.0 wt. % of a migration inhibitor. One type of compounds which can act as migration inhibitors are polymerized alpha olefins, more particularly polymerization products formed alpha olefins having at least 10 carbon atoms and, more commonly from one or more alpha olefins having 10 to about 25 carbon atoms. One suitable example of such as polymer is an alpha olefin polymer sold under the tradename Vybar® 103 polymer (mp 168° F. (circa 76° C.); available from Baker-Petrolite, Sugarland, Tex.). The inclusion of sorbitan triesters, such as sorbitan tristearate and/or sorbitan tripalmitate and related sorbitan triesters formed from mixtures of fully hydrogenated fatty acids, in the present wax compositions may also decrease the propensity of colorants, fragrance components and/or other components of the wax to migrate to the candle surface. The inclusion of either of these types of migration inhibitors can also enhance the flexibility of the base wax material and decrease its chances of cracking during the cooling processes that occur in candle formation and after extinguishing the flame of a burning candle. For example, it may be advantageous to add up to about 5.0 wt. % and, more commonly, about 0.1-2.0 wt. % of a migration inhibitor, such as is an alpha olefin polymer, to the present wax materials.

ILLUSTRATIVE EMBODIMENTS

A number of illustrative embodiments of the present candle wax and candles produced therefrom are described below. The embodiments described are intended to provide illustrative examples of the present wax and candles and are not intended to limit the scope of the invention.

One embodiment is directed to a candle wax which includes at least about 70 wt. % of a triacylglycerol component and about 5 to 25 wt. % of a polyol monoester component. The polyol monoester component commonly includes glycerol fatty acid monoester and/or sorbitan fatty acid monoester. The wax typically has an Iodine Value of about 20 to 40. The wax normally has a very low free fatty acid content, typically no more than about 1.0 wt. %. The triacylglycerol component typically has a fatty acid composition which includes about 50 to 70 wt. % saturated fatty acid(s) and about 30 to 45 wt. % 18:1 fatty acid. The melting point of the candle wax is generally about 54-63° C. (circa 130 to 145° F.). The triacylglycerol component typically includes hydrogenated vegetable oil. For example, the wax can include hydrogenated soybean oil, hydrogenated cottonseed oil, hydrogenated sunflower oil, hydrogenated canola oil, hydrogenated corn oil, hydrogenated palm oil, hydrogenated olive oil, hydrogenated peanut oil, hydrogenated safflower oil or a mixture thereof. Typically, the hydrogenated vegetable oil includes hydrogenated bleached, refined vegetable oil. The melting point of the triacylglycerol component is desirably about 54 to 63° C.

Another embodiment provides a triacylglycerol-based candle wax comprising a triacylglycerol component and a polyol fatty acid partial ester component; wherein the triacylglycerol-based wax has a melting point of about 54° C. to 63° C.; and the triacylglycerol component has a fatty acid profile including about 30 to 45 wt. % 18:1 fatty acids. The triacylglycerol component desirably has a fatty acid profile including about 50 to 65 wt. % saturated fatty acids and an Iodine Value of about 30 to 40. The wax desirably includes no more than about 1.0 wt. % free fatty acid.

Another embodiment is directed to a triacylglycerol-based candle wax including a triacylglycerol component and a polyol fatty acid partial ester component; wherein the triacylglycerol-based wax has a melting point of about 54° C. to 63° C. and the triacylglycerol component has a fatty acid profile including about 50 to 70 wt. % saturated fatty acids. The triacylglycerol component can have an Iodine Value of about 30 to 45 and a fatty acid profile which includes about 30 to 45 wt. % 18:1 fatty acids.

Another embodiment can be produced predominantly from hydrogenated soybean oil. The partial ester component can be produced by partial hydrolysis of a fully hydrogenated soybean oil followed by isolation of the monoester fraction. The triacylglycerol component can be formed from hydrogenated soybean oil and desirably has a fatty acid profile including about 8 to 12 wt. % 16:0 fatty acid, about 40 to 45 wt. % 18:1 fatty acids and about 40 to 45 wt. % 18:0 fatty acid. Optionally, this candle wax may include a small amount, e.g., about 0.5 to 2.0 wt. % of a polymerized alpha olefin migration inhibitor, such as Vybar® 103 polymer.

Another embodiment can be formed by blending fully hydrogenated palm oil with a partially hydrogenated soybean oil to form the triacylglycerol component. About 85 to 95 wt. % of this triacylglycerol component can be blended with about 5 to 15 wt. % of a glycerol fatty acid monoester component, such as glycerol monopalmitate and/or glycerol monostearate, to form a candle wax suitable for forming votive candles. The triacylglycerol component can have a fatty acid profile including about 20 to 25 wt. % 16:0 fatty acid, about 40 to 45 wt. % 18:1 fatty acids and about 30 to 35 wt. % 18:0 fatty acid. The total amount of saturated fatty acids in the fatty acid profile of the triacylglycerol component is desirably about 50 to 60 wt. %. Optionally, the candle wax may include a small amount, e.g., about 0.5 to 2.0 wt. % of a polymerized alpha olefin migration inhibitor, such as Vybar® 103 polymer.

Candles formed from the present vegetable oil-based candle include a wick and the vegetable oil-based wax. In one embodiment, the vegetable oil-based wax includes a polyol fatty acid partial ester component. The partial ester component typically includes at least about 90 wt. % polyol monoesters of palmitic acid, stearic acid or a mixture thereof. The triacylglycerol component has a melting point of about 54 to 63° C. and fatty acid composition which includes about 8 to 25 wt. % 16:0 fatty acid; about 30 to 60 wt. % 18:0 fatty acid; and about 30 to 45 wt. % 18:1 fatty acid. The candle wax can include other additives. For instance, the wax may often include colorant. Another additive which is commonly added to candle wax formulations is fragrance oil, typically present as about 3-5 wt. % of the vegetable oil-based wax. For some applications, it may be advantageous to include insect repellant (e.g., citronella or neem oil) in the wax formulation The wax used to form the present candles desirably includes at least about 70 wt. % of the triacylglycerol component and includes about 5 to 25 wt. % of the polyol fatty acid partial ester. Particularly suitable waxes include a triacylglycerol component which has an Iodine Value of about 30 to 45. The polyol fatty acid partial ester component desirably includes about 5 to 15 wt. % glycerol monoesters of saturated fatty acids. It is often particularly desirable to employ a vegetable oil-based wax with a melting point of about 57 to 63° C. to form the present candles.

Another embodiment is directed to a candle wax which includes at least about 80 wt. % of a triacylglycerol component and about 3 to 15 wt. % of a glycerol fatty acid monoester component. The triacylglycerol-based wax desirably has a melting point of about 54° C. to 63° C., an Iodine Value of about 20 to 40 and contains no more than about 1.0 wt. % free fatty acid. The triacylglycerol component has a fatty acid profile including about 50 to 65 wt. % saturated fatty acids and about 30 to 45 wt. % 18:1 fatty acids. The glycerol fatty acid monoester preferably has an Iodine Value of no more than about 10 and includes glycerol monostearate, glycerol monopalmitate or a mixture thereof.

A particularly suitable embodiment is directed to a candle wax which includes a triacylglycerol component and a glycerol fatty acid monoester component and has an Iodine Value of about 25 to 30. The triacylglycerol component has a fatty acid profile including about 30 to 35 wt. % 18:1 fatty acids and about 60 to 65 wt. % saturated fatty acids. The wax desirably includes about 85 to 95 wt. % of the triacylglycerol component and about 5 to 15 wt. % of the glycerol fatty acid monoester component. The glycerol fatty acid monoester suitably has an Iodine Value of no more than about 10 and includes glycerol monostearate, glycerol monopalmitate or a mixture thereof. Optionally, this candle wax may include a small amount, e.g., about 0.5 to 2.0 wt. % of a polymerized alpha olefin migration inhibitor, such as Vybar® 103 polymer.

Another embodiment is directed to a candle which includes a wick and the triacylglycerol-based wax. The triacylglycerol-based wax desirably includes about 3 to 30 wt. % of a polyol fatty acid partial ester component and at least about 70 wt. % of a triacylglycerol component having a melting point of about 54-63° C. The triacylglycerol component desirably has an Iodine Value of about 35 to 45; and a fatty acid composition which includes about 50 to 70 wt. % saturated fatty acid(s). Typically the fatty acid composition which includes about 8 to 25 wt. % 16:0 fatty acid; about 30 to 60 wt. % 18:0 fatty acid; and about 30 to 45 wt. % 18:1 fatty acid. The candle is desirably formed from a vegetable oil-based wax which has a melting point of about 57 to 60° C.

A method of producing a candle is provided by another embodiment. The method includes heating a vegetable oil-based wax to a molten state; and solidifying the molten vegetable oil-based wax around a portion of a wick. A related method of producing a candle includes heating a vegetable oil-based wax to a molten state; pouring the molten vegetable oil-based wax into a mold which includes a wick disposed therein; and solidifying the molten vegetable oil-based wax. In the formation of votive and pillar candles, the solidified wax is then removed from the mold, generally after it has cooled to room temperature. The triacylglycerol-based wax employed in these methods typically includes a polyol fatty acid partial ester component and a triacylglycerol component having a fatty acid composition which including about 8 to 25 wt. % 16:0 fatty acid; about 30 to 60 wt. % 18:0 fatty acid; and about 30 to 45 wt. % 18:1 fatty acid. The fatty acid composition of the triacylglycerol component generally includes about 50 to 70 wt. % saturated fatty acids, such as palmitic acid and stearic acid. The triacylglycerol component desirably has a melting point of about 54-60° C. and an Iodine Value of about 25 to 45. The vegetable oil-based wax commonly has a melting point of about 54 to 63° C. and is typically heated to at least about 5° C. (circa 10° F.) above its melting point to convert it into the molten state.

The following example is presented to illustrate the present invention and to assist one of ordinary skill in making and using the same. The example is not intended in any way to otherwise limit the scope of the invention.

EXAMPLE 1

A vegetable oil-based wax suitable which can be used in making votive candles was produced according to the following procedure. A blend of partially hydrogenated refined, bleached soybean oil (60 wt. %), fully hydrogenated palm oil (35 wt. %) and 5 wt. % monoglycerol esters of a mixture of fatty acids derived from hydrolysis of hydrogenated soybean oil (available under the tradename Dimodan® from Denisco, Inc., New Century, Kans.), was heated to 170° F. (circa 77° C.) and stirred to thoroughly blend the components. The partially hydrogenated refined, bleached soybean oil had a melting point of 112-115° F. (circa 44-46° C.) and an Iodine Value of 60-64. The resulting blend had a melting point of 131° F. (55° C.) and an Iodine Value of about 36-40. Typical fatty acid profiles for fully hydrogenated palm oil ("Fully [H] Palm Oil") and the partially hydrogenated refined, bleached soybean oil and are shown in Table 1 below. The fatty acid profile of a typical refined, bleached soybean oil ("RB-SBO") is also shown for comparison.

TABLE 1

| Fatty Acid Compositions (Wt. %) | | | |
|---|---|---|---|
| Fatty Acid(s) | RB-SBO | Partially [H] RB-SBO | Fully [H] Palm Oil |
| ≦C14 | <0.1 | <0.3 | 1-2 |
| 16:0 | 10-11 | 10.4 | 42-44 |
| 18:0 | 4-6 | 18.3 | 53-55 |
| 18:1 | 20-30 | 66.8 | — |
| 18:2 | 50-60 | 2.9 | — |
| 18:3 | 5-10 | 0.1 | — |
| Other | <1 | 1.0 | — |

If other additives such as colorants and/or fragrance oils are to be included in the candle formulation, these may be added to the molten triglyceride/glycerol monoester blend or mixed with a blend of the molten triacylglycerol components prior to the addition of the polyol fatty acid monoester component. Other additives which may be added include additives typically used in the production of candle to prevent the migration of fragrance and/or colorants in the wax, such as polymerization products formed from alpha olefins having greater than 10 carbon atoms (e.g., an alpha olefin polymer available under the tradename Vybar® 103 polymer from Baker-Petrolite, Sugarland, Tex.).

The final candle formulation may be used to directly produce candles or may be stored in a molten state in a heated tank. Often it may be more convenient to cool and convert the candle wax into particle form. As described herein, the molten candle wax may be converted in flakes or prilled granules to facilitate handling and storage in small lots.

EXAMPLE 2

A vegetable oil-based wax suitable for use in making votive candles can be produced according to the following procedure. A blend of the same partially hydrogenated refined, bleached soybean oil employed in Example 1 (60 wt. %), fully hydrogenated soybean oil (30 wt. %), Dimodan® (5 wt. %), and sorbitan tristearate (5 wt. %; available from Dinesco, Inc., New Century, Kans., under the tradename Grindstec STS) is heated to 170° F. (circa 77° C.) and stirred to thoroughly blend the components. The resulting blend has a melting point of 131° F. (55° C.) and an Iodine Value of about 36-39. Typical fatty acid profiles for fully hydrogenated soybean oil ("Fully [H] RB-SBO") and the partially hydrogenated refined, bleached soybean oil and are shown in Table 2 below.

TABLE 2

| Fatty Acid Compositions (Wt. %) | | | |
|---|---|---|---|
| Fatty Acid(s) | RB-SBO | Partially [H] RB-SBO | Fully [H] RB-SBO |
| ≦C14 | <0.3 | <0.3 | <0.3 |
| 16:0 | 10-11 | 10.4 | 10-11 |
| 18:0 | 4-6 | 18.3 | 88-89 |
| 18:1 | 20-30 | 66.8 | — |
| 18:2 | 50-60 | 2.9 | — |
| 18:3 | 5-10 | 0.1 | — |
| Other | <1 | 1.0 | — |

If other additives such as colorants and/or fragrance oils are to be included in the candle formulation, these may be added to the molten blend of triacylglycerol/glycerol monoester/sorbitan triester or mixed with a blend of the molten triacylglycerol components prior to the addition of the glycerol monoester and/or sorbitan triester. The final candle formulation may be used to directly produce candles, stored in a molten state (e.g., in a heated tank) or converted into particle form.

EXAMPLE 3

A number vegetable oil-based waxes suitable for use in making votive candles can be produced according to the procedure described in Example 1 above. For example, suitable blends can be formed from varying amounts of the same partially hydrogenated refined, bleached soybean oil employed in Example 1, Dimodan® monoester, fully hydrogenated soybean oil and/or fully hydrogenated palm oil. The composition of a number of wax blends are shown in Table 3 below. A number of these blends were produced and used to form 1.5" diameter votive candles. The "Comments" column of Table 3 includes a characterization of the amount of cracking observed in the initial formation of the votive candles. The entry for the first blend listed reflects the fact that the surface adhesion for this blend was apparently high enough to causes problems with mold release.

TABLE 3

| Wax Blends (Wt. %) | | | | | |
|---|---|---|---|---|---|
| Part. [H] RB-SBO | Fully [H] RB-SBO | Fully [H] Palm Oil | Dimodan ® Monoester | Tot. Blend m.p. (° F.) | Comments* |
| 65 | 30 | — | 5 | 129 | No Mold Release |
| 60 | 30 | — | 10 | 134 | No Cracks |
| 60 | 35 | — | 5 | 134 | Slight Cracks |
| 60 | 37 | — | 3 | 133 | Cracked |
| 35 | 40 | — | 25 | 142 | No Cracks |
| 55 | — | 40 | 5 | 128 | Cracks |
| 50 | — | 40 | 10 | 130 | Slight Cracks |
| 60 | — | 35 | 5 | 131 | No Cracks |
| 60 | — | 30 | 10 | 132 | No Cracks |
| 45 | 25 | 20 | 10 | 135 | No Cracks |
| 40 | 20 | 20 | 20 | — | — |
| 35 | 30 | 10 | 25 | — | — |
| 15 | 40 | 40 | 5 | 144 | Some Cracks |

*comments relate to formation of 1.5 inch diameter votive candle from formulations

EXAMPLE 4

A vegetable oil-based wax suitable for use in making votive candles was produced according to the procedure described in Example 1. The blend was formed from the same partially hydrogenated refined, bleached soybean oil employed in Example 1 (60 parts by wt.; 59.4%), fully hydrogenated palm oil (35 parts by weight; 34.7 wt. %), Dimodan®® glycerol monester (5 parts by wt.; 5.0 wt. %) and Vybar® 103 alpha olefin polymer (1 part by wt.; 1.0 wt. %). The resulting blend has a melting point of 132° F. (circa 56° C.) and an Iodine Value of about 35-38.

EXAMPLE 5

A vegetable oil-based wax suitable for use in making votive, pillar or taper candles was produced according to the procedure described in Example 1. The blend was formed from fully hydrogenated soybean oil (25 parts by wt.; 24.8 wt. %), the same partially hydrogenated refined, bleached soybean oil employed in Example 1 (45 parts by wt.; 44.6 wt. %), fully hydrogenated palm oil (20 parts by weight; 19.8 wt. %), Dimodan® glycerol monoester (5 parts by wt.; 5.0 wt. %) and Vybar® 103 alpha olefin polymer (1 part by wt.; 1.0 wt. %). The resulting blend has a melting point of 136° F. (circa 58° C.) and an Iodine Value of about 27-29.

The invention has been described with reference to various specific and illustrative embodiments and techniques. However, it should be understood that many variations and modifications may be made while remaining within the spirit and scope of the invention.

What is claimed is:

1. A method of producing a prilled candle wax comprising:

spraying a molten waxy material through a nozzle to form finely dispersed liquid wax particles;

cooling the finely dispersed liquid wax particles to form prilled granules;

wherein the molten waxy material has a melting point of about 54° C. to 63° C. and comprises a triacylglycerol component and a polyol fatty acid partial ester component.

2. The method of Claim 1 wherein the molten waxy material is substantially devoid of paraffin.

3. The method of Claim 1 wherein the molten waxy material has a free fatty acid content of no more than about 0.5 wt. %

4. the method of Claim 1 wherein the molten waxy material comprises at least about 70 wt. % of the triacylglycerol component.

5. The method of Claim 4 wherein the molten waxy material further comprises a colorant additive.

6. The method of Claim 1 wherein the molten waxy material has an iodine Value of about 20 to 40.

7. The method of Claim 1 wherein the triacylglycerlol component comprises hydrogenated soybean oil, hydrogenated sunflower oil, hydrogenated canola oil, or a mixture thereof.

8. The method of Claim1 wherein the triacylglycerol component comprises hydrogenated palm oil.

9. The method of Claim 8 wherein the hydrogenated palm oil has an Iodine Value of no more than about 5.

10. The method of Claim 1 wherein the triacylglycerol component has a fatty acid composition including about 50 to 70 wt. % saturated fatty acids and about 30 to 45 wt. % 18:1 fatty acids.

11. A method of producing a candle comprising:

spraying a molten waxy material through a nozzle to form finely dispersed liquid wax particles;

solidifying the finely dispersed liquid wax to form prilled wax granules; and compression molding the prilled wax granules to form a candle; wherein the molten waxy material has a melting point of about 54° C. to 63° C. and comprises a triacylglycerol component and a polyol fatty acid partial ester component;

and is substantially devoid of paraffin.

12. The method of Claim 11 wherein solidifying the finely dispersed liquid wax comprises contacting the finely dispersed liquid wax with cooler air.

13. The method of Claim 11 wherein solidifying the finely dispersed liquid wax comprises contacting the finely dispersed liquid wax with cooler air as the dispersed liquid wax falls through a cooling chamber.

14. The method of Claim 11 further comprising inserting a wick into the compression molded candle.

15. The method of Claim 11 wherein the triacylglycerol component has a fatty acid profile including about 20 to 25 wt. % 16:0 fatty acid, about 40 to 45 wt. % 18:1 fatty acids and about 30 to 35 wt. % 18:0 fatty acid.

16. The method of Claim 11 wherein the molten waxy material comprises at least about 70 wt. % of the triacylglycerol component.

17. The method of Claim 11 wherein the triacylglycerol component includes hydrogenated soybean oil, hydrogenated cottonseed oil, hydrogenated sunflower oil, hydrogenated canola oil, hydrogenated corn oil, hydrogenated palm oil, hydrogenated olive oil, hydrogenated peanut oil, hydrogenated safflower oil or a mixture thereof.

18. The method of Claim 11 wherein the molten waxy material further comprises a migration inhibitor.

19. The method of Claim 18 wherein the migration inhibitor includes a polymer formed from polymerization of one or more alpha olefins having at least 10 carbon atoms.

20. The method of Claim 11 wherein the polyol fatty acid partial ester component comprises a glycerol fatty acid monoester, which has an Iodine Value of no more than about 10 and includes glycerol monostearate, glycerol monopalmitate or a mixture thereof.

21. A method of producing a candle comprising:

forming prilled wax granules from a molten waxy material;

compression molding the prilled wax granules to form a candle;

wherein the molten waxy material has a melting point of about 54° C. to 63° C. and comprises a triacylglycerol component and a polyol fatty acid partial ester component.

* * * * *

UNITED STATES PATENT AND TRADEMARK OFFICE

CERTIFICATE OF CORRECTION

PATENT NO. : 7,462,205 B2
APPLICATION NO. : 10/863662
DATED : December 9, 2008
INVENTOR(S) : Timothy A. Murphy It is certified that error appears in the above-identified patent and that said Letters Patent is hereby corrected as shown below:

On the Title Page Item (56)

Page 2, line 5, after "available @" delete "http:/www" and substitute --http://www-- in its place.

In column 16, claim 6, line 22, after "has an" delete "iodine" and substitute --Iodine-- in its place.

Signed and Sealed this

Thirtieth Day of June, 2009

JOHN DOLL
*Acting Director of the United States Patent and Trademark Office*